US006825579B2

(12) United States Patent
Ehrlich et al.

(10) Patent No.: US 6,825,579 B2
(45) Date of Patent: Nov. 30, 2004

(54) SAFETY SWITCHING APPARATUS HAVING A FIRST AND A SECOND INPUT SWITCH AND METHOD OF MANUFACTURING THE SAME

(75) Inventors: Gerhard Ehrlich, Reichenbach (DE); Boris Kaufmann, Stuttgart (DE)

(73) Assignee: Pilz GmbH & Co., Ostfildern (DE)

( * ) Notice: Subject to any disclaimer, the term of this patent is extended or adjusted under 35 U.S.C. 154(b) by 181 days.

(21) Appl. No.: 10/225,941

(22) Filed: Aug. 22, 2002

(65) Prior Publication Data

US 2003/0057069 A1 Mar. 27, 2003

Related U.S. Application Data

(63) Continuation of application No. PCT/EP01/01728, filed on Feb. 16, 2001.

(30) Foreign Application Priority Data

Feb. 29, 2000 (DE) ..... 100 09 707

(51) Int. Cl.[7] ..... H01H 19/64

(52) U.S. Cl. ..... 307/113; 307/141.8; 200/11 D; 200/11 DA

(58) Field of Search ..... 200/11 D, 11 DA; 307/113, 141.8; 361/187

(56) References Cited

U.S. PATENT DOCUMENTS 3,683,368 A 8/1972 Ebner 4,313,105 A 1/1982 Ananthan et al.

FOREIGN PATENT DOCUMENTS

| | | |
|---|---|---|
| DE | 1059536 | 1/1961 |
| DE | 2545719 | 4/1977 |
| DE | 30 17 244 A1 | 11/1981 |

OTHER PUBLICATIONS

Pilz, Technical Instructions, Nr. 19 244, 7 pages.

Pilz GmbH & Co., NOT–AUS–Schaltgeräte, Schutztürwächter, Kategorie 4, EN 954–1, 4 pages.

*Primary Examiner*—Robert L DeBeradinis
(74) *Attorney, Agent, or Firm*—Harness, Dickey & Pierce, P.L.C.

(57) ABSTRACT

The present invention relates to a safety switching apparatus having a first and a second input switch, whose respective switch settings define an input-side manipulated variable redundantly with respect to one another. The safety switching apparatus furthermore has at least one output switching element which is arranged in an output circuit. In addition, an evaluation and control unit is provided, which drives the at least one output switching element as a function of the defined manipulated variable. Switching contacts of the first and of the second input switch are coupled with one another, in terms of their switch positions, via a common actuating member. According to one aspect of the invention, the switching contacts of the first and of the second input switch are spatially arranged in one plane.

18 Claims, 5 Drawing Sheets

SAFETY SWITCHING APPARATUS HAVING A FIRST AND A SECOND INPUT SWITCH AND METHOD OF MANUFACTURING THE SAME

CROSS-REFERENCES TO RELATED APPLICATIONS

This application is a continuation of copending international patent application PCT/EP01/01728 filed on Feb. 16, 2001 and designating the U.S., which claims priority from German patent application DE 100 09 707.3, filed on Feb. 29, 2000.

BACKGROUND OF THE INVENTION

The present invention relates to a safety switching apparatus and a method of manufacturing the same. The invention particularly relates to a safety switching apparatus having a first and a second input switch, whose respective switch settings define an input-sided manipulated variable redundantly with respect to one another, further having at least one output switching element which is arranged in an output circuit of the safety switching apparatus, and having an evaluation and control unit which drives or controls the at least one output switching element as a function of the defined manipulated variable, wherein the switching contacts of the first and of the second input switch are coupled to one another, in terms of their switch positions, via a common actuating member.

A safety switching apparatus of this type is distributed by the applicant of the present invention under the type designation PNOZ XV2.

The safety switching apparatuses in the meaning of the present invention comprise both autonomous safety switching devices and complex safety controllers and control systems, for example based on a fail-safe PLC controller. Apparatuses such as these are used primarily in the industrial field, in order to carry out switching processes safely. In this context, "safe" means that the apparatus complies with at least Category 3 of European Standard EN 954-1. By way of example, apparatuses such as these are used in order to stop, or in some other way to change to a safe state, a machine system from which a hazard has originated, as a reaction to the operation of an emergency-off button or the opening of a protective guard door. Since failure of the apparatus in a situation such as this results in a direct hazard to people or else to material values, the fail-safety of safety switching apparatuses is subject to very stringent requirements. This leads to a high level of complexity associated with high costs for the development and manufacture of safety switching apparatuses.

In the known safety switching apparatus, the input-side manipulated variable is a time constant, which governs a delay time for switching off. A delay time such as this is required, for example, in order to make it possible to move moving drives in a controlled manner to a safe rest position when switching off a machine system. In the case of the known safety switching apparatus, the time constant is set by means of two mutually redundant rotary switches, which are arranged one above the other or one behind the other on a common shaft. This configuration is explained in more detail further below, with reference to FIG. 2.

In general, however, the manipulated variable that is to be set may be any input parameter which is relevant for a safety switching apparatus.

The known safety switching apparatus satisfies the safety requirements of Standard EN 954-1 in particular because the two input switches each define the desired time constant separately from one another. The resultant redundancy means that a fault in one of the switches can be identified reliably by the evaluation and control unit. However, this has the disadvantage that a large amount of mechanical complexity is required in the manufacture of the known safety switching apparatus, and this is associated with correspondingly high costs. Furthermore, the configuration of the known safety switching apparatus occupies a comparatively large amount of space, which prevents miniaturization of apparatuses of this generic type, or at least makes it more difficult.

SUMMARY OF THE INVENTION

It is one object of the present invention to specify a safety switching apparatus of the type mentioned initially, which is configured in more simple and more space-saving manner while still satisfying the same stringent safety requirements.

According to one aspect of the invention, this object is achieved in that the switching contacts of the first and of the second input switches are spatially arranged in one plane.

In contrast to this, the switching contacts of the two input switches in the known safety switching apparatus are located in two planes which are offset parallel to one another. This means that the two input switches must be mounted in the enclosure of the safety switching apparatus in two separate process steps. In contrast to this, the two input switches in the safety switching apparatus according to the invention can be mounted in a single process step. This simplifies the manufacture, and the safety switching apparatus according to the invention can be produced more cost-effectively.

Furthermore, as will be shown in the following text on the basis of preferred refinements of the invention, the physical space required for the two input switches can be reduced considerably, so that the safety switching apparatus according to the invention can be implemented in a spatially smaller way overall. Nevertheless, despite all this, it is still possible to use input switches which are separate from one another, and are thus redundant with respect to one another. The required fail-safety thus remains completely preserved.

In a preferred refinement of the invention, the actuating member comprises a common mounting element, on which the switching contacts of the first and of the second input switch are arranged such that they are spatially offset with respect to one another.

This measure has the advantage that the switching contacts of the two input switches are constructionally coupled in a very simple, and hence cost-effective, manner. It is thus possible to dispense with couplings, drives and other measures for transmitting a switching movement from the first input switch to the second, without this resulting in any risk of a different operator setting.

In a further refinement of the measure mentioned above, the common mounting element can be rotated for adjustment.

As an alternative to this, it is also feasible to design the common mounting element such that it can be translated for adjustment. In contrast to this, the preferred refinement is particularly advantageous when the two input switches are multiposition switches, since the switching contacts in this case can thus be arranged in a more space-saving manner with respect to one another, and thus in a spatially smaller manner.

In a further refinement of the measures mentioned above, the common mounting element is a mounting disk, on which the switching contacts of the first and of the second input switch are arranged radially offset with respect to one another.

This measure allows the two input switches, which are separate from one another, to be integrated in a particularly spatially small and space-saving manner in a common mechanical structure. Furthermore, this also simplifies the process of installing the input switches in the enclosure of the safety switching apparatus according to the invention.

In a further refinement of the invention, the first and the second input switch as well as the common actuating member are enclosed by a common switch enclosure.

This measure has the advantage that the input switches, which are separate from one another, form a common, intrinsically redundant component, which can be mounted in a very simple and hence cost-effective manner in the safety switching apparatus according to the invention. Furthermore, the fail-safety is improved even further, since the risk of damage to the redundant switch arrangement during the installation process or during any subsequent intervention in the safety switching apparatus is reduced. Furthermore, the safety-relevant switch arrangement is in this way protected particularly well against external environmental influences, such as dirt. This also contributes to improving the fail-safety.

In a further refinement of the invention, the switching contacts of the first and of the second input switch are sliding contacts, which can be moved over stationary contact surfaces by means of the actuating member.

This measure allows a particularly simple mechanical configuration, especially when the switching contacts are arranged on a common mounting element as the actuating member.

In a further refinement of the measure mentioned above, the contact surfaces are conductive track structures which are applied to a printed circuit board.

This measure allows the two input switches to be produced even in very large quantities in a fail-safe manner, thus minimizing the costs for the two input switches. At the same time, it is in this case possible, by means of a suitable design of the conductive track structures, to provide switching paths which include internal circuit logic. As a consequence of this, even complicated circuit schemes can be implemented in a simple and reproducible manner. Furthermore, this measure further improves the fail-safety, since conductive track structures are not subject to any wear, or at most are subject to extremely low wear, during operation of the apparatus, thus largely precluding any faults occurring only subsequently during operation of the apparatus. The risk of subsequently occurring cross-connections or short-circuits is likewise reduced.

In a further refinement of the invention, the first and the second input switches are each multiposition switches.

This measure can be implemented particularly easily in conjunction with the refinements of the invention mentioned above. This has the advantage that the safety switching apparatus according to the invention has a large number of setting options, thus improving its range of use and its adaptability. This means that larger quantities can be produced, and this leads to a cost reduction.

In a further refinement of the invention, the first and the second input switch have input-sided and output-sided connecting contacts or terminal contacts, which are arranged in a matrix structure with respect to one another.

This measure has the advantage that the number of connecting contacts required for the two input switches can be reduced, which likewise allows the physical space required to be reduced. Furthermore, this also simplifies the manufacture process.

In a further refinement of the measure mentioned above, the input-side connecting contacts of the first and of the second input switch are connected to one another.

This measure once again reduces the number of connections required for the two input switches. For example, this measure makes it possible to provide 16 mutually redundant switch positions, that is to say a total of 32 switch positions, with a total of only 12 connecting contacts. As a consequence of this, the physical space for the arrangement according to the invention can be further reduced, and the manufacture process simplified.

In a further refinement of the invention, the evaluation and control unit has two channels, with a first channel being connected to the first input switch, and a second channel being connected to the second input switch.

This measure has the advantage that the safety switching apparatus has a generally redundant design, thus making it possible to achieve a particularly high level of fail-safety.

It goes without saying that the features which have been mentioned above as well as those which are still to be explained in the following text can be used not only in the respectively stated combination but also in other combinations or on their own, without departing from the scope of the present invention.

BRIEF DESCRIPTION OF THE DRAWINGS

Exemplary embodiments of the invention are illustrated in the drawing and will be explained in more detail in the following description. In the drawing.

DETAILED DESCRIPTION OF PREFERRED EMBODIMENTS

Figure 1:
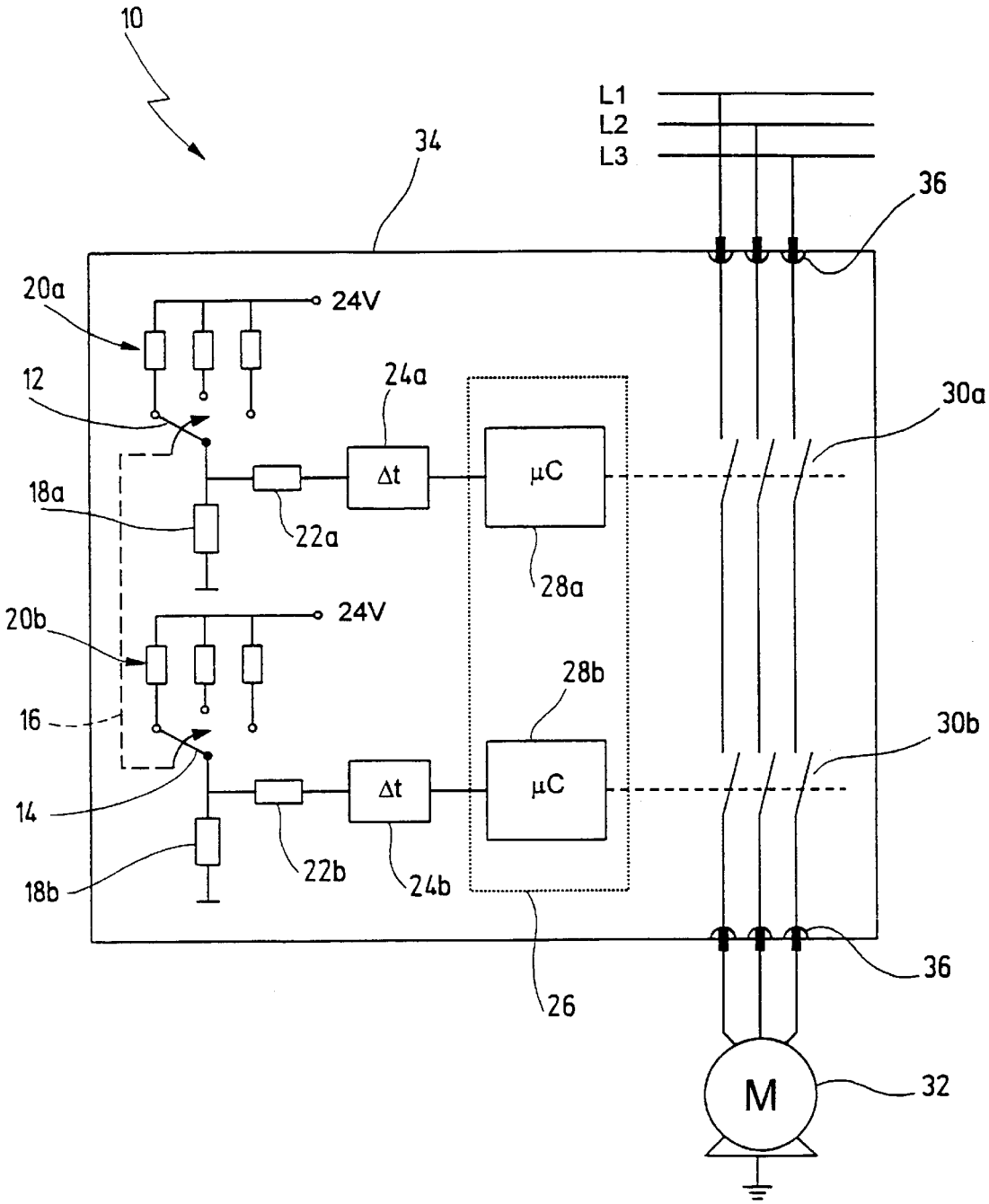
FIG. 1 shows the circuit configuration of a safety switching apparatus according to the invention, in the form of a safety switching device.

In FIG. 1, a safety switching apparatus according to the invention, in the form of a safety switching device, is denoted by reference number 10.

The safety switching device 10 has two mutually redundant input switches 12 and 14 which are coupled to one another, with regard to their switch positions, via a common actuating member 16, which is illustrated only schematically here. The input switches 12, 14 are included in an identical manner in a respective voltage divider, which is in each case formed from a respective resistor 18*a*, 18*b* and a respective resistor group 20*a*, 20*b*. The resistor groups 20*a*, 20*b* in the present exemplary embodiment include three resistors, which are arranged in parallel with one another and have different resistance values. An operating voltage, which in the present exemplary embodiment is 24 V, is applied across the two voltage dividers. Depending on the respective switch positions of the input switches 12, 14, the two voltage dividers produce an output signal which is supplied via a respective further resistor 22*a*, 22*b* to a timer 24*a*, 24*b*. The timers 24*a*, 24*b* define, redundantly with respect to one another and as a function of the respectively received voltage, a time constant which is supplied to an evaluation and control unit 26. The received voltage in this case depends on the respective switch position of the two input switches 12, 14.

The evaluation and control unit 26 in the present exemplary embodiment has two channels, and has a microcontroller 28*a*, 28*b* in each channel. The microcontrollers 28*a*, 28*b* additionally evaluate further input signals, which are not illustrated here, and which are generated, by way of example, by an emergency-off button or a protective guard. The microcontrollers 28*a*, 28*b* drive the respective output switching contacts 30*a*, 30*b* as a function of these input signals and of the time constants, which are defined redundantly with respect to one another. The output switching contacts 30*a*, 30*b* are arranged in series with one another in a power supply path to a machine system 32.

The invention is not restricted to safety switching apparatuses having outputs with contacts. Instead of the relay contacts 30*a*, 30*b* used here, it is also possible to use semiconductor elements as output switching elements.

The overall safety switching device 10 is accommodated in a device enclosure 34 which, in a manner known per se, has connecting terminals 36 for connection of the power supply and of the machine system 32.

In the description of the other figures in the following text, identical reference numbers denote the same elements as in FIG. 1.

Figure 2:
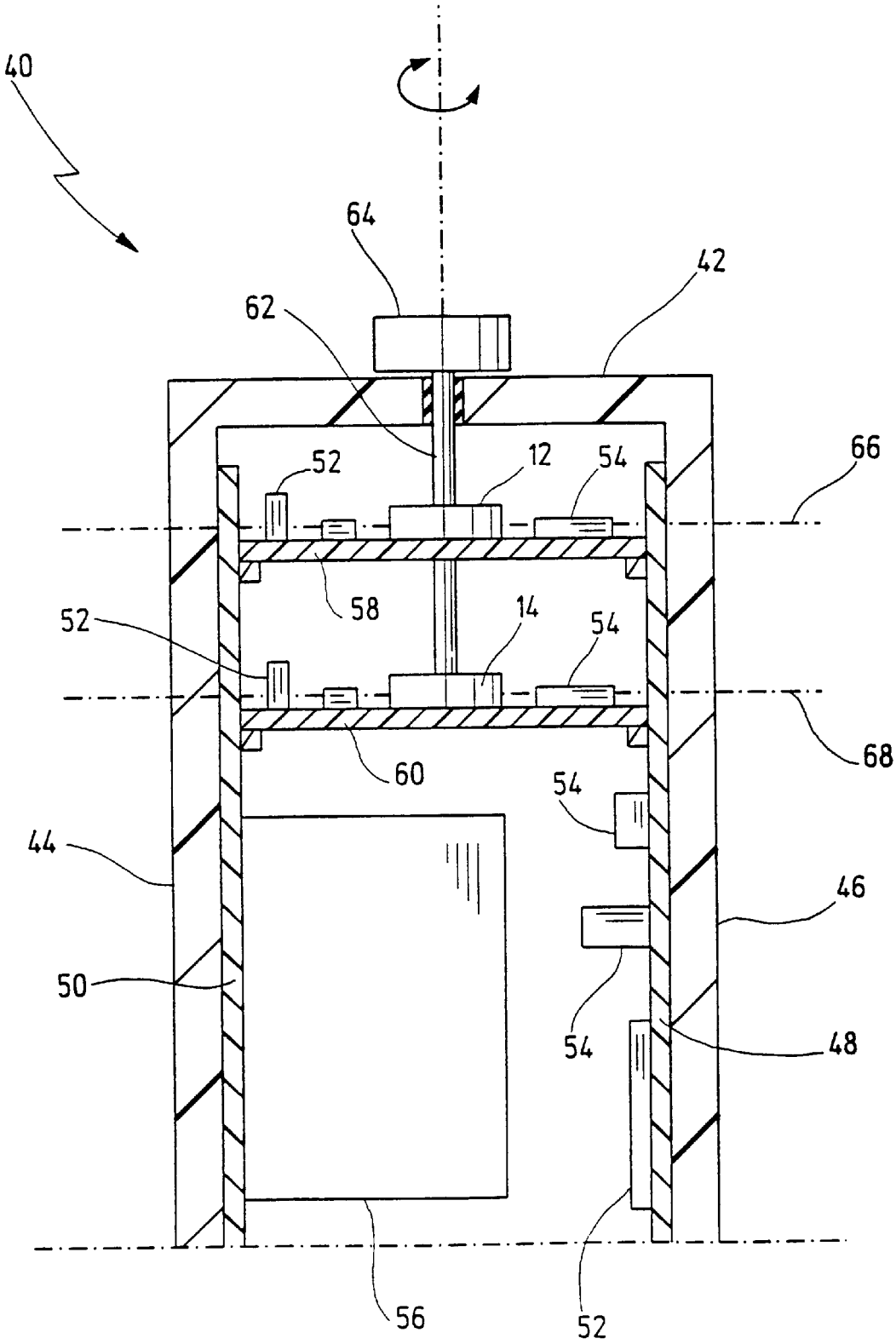
FIG. 2 shows a cross section of a prior art safety switching device.

In FIG. 2, a safety switching device of this generic type, as is distributed by the applicant for the present invention, is denoted in its totality by reference number 40.

The enclosure 34 of the safety switching device 40 has, as can be seen, a front face 42 as well as two side walls 44, 46 in the present cross-section illustration. Component mounts in the form of so-called printed circuit boards 48, 50 are arranged along each of the two side walls 44, 46 in the interior of the enclosure 34. By way of example, individual components with reference numbers 52 and 54 are shown on the circuit board 48. Likewise by way of example, the comparatively large casing of a relay 56, which contains the output switching contacts 30*a*, 30*b*, is shown on the circuit board 50.

The reference numbers 58 and 60 denote two further circuit boards, which are mounted between the circuit boards 48 and 50, parallel to the front face 42 and parallel to one another. The input switches 12 and 14 are also located on these two circuit boards, in addition to the further components 52, 54. The switches are rotary switches, which are mounted one above the other or one behind the other on a common shaft 62. The shaft 62 emerges to the exterior on the front face 42 of the enclosure 34, where it is connected to a rotary knob 64. The shaft 62 thus forms a common actuating member for the two input switches 12 and 14. In this case, the switching contacts of the two input switches 12 and 14 are arranged in different planes 66, 68, which are offset parallel to one another, as can be seen in the illustration in FIG. 2.

Figure 3:
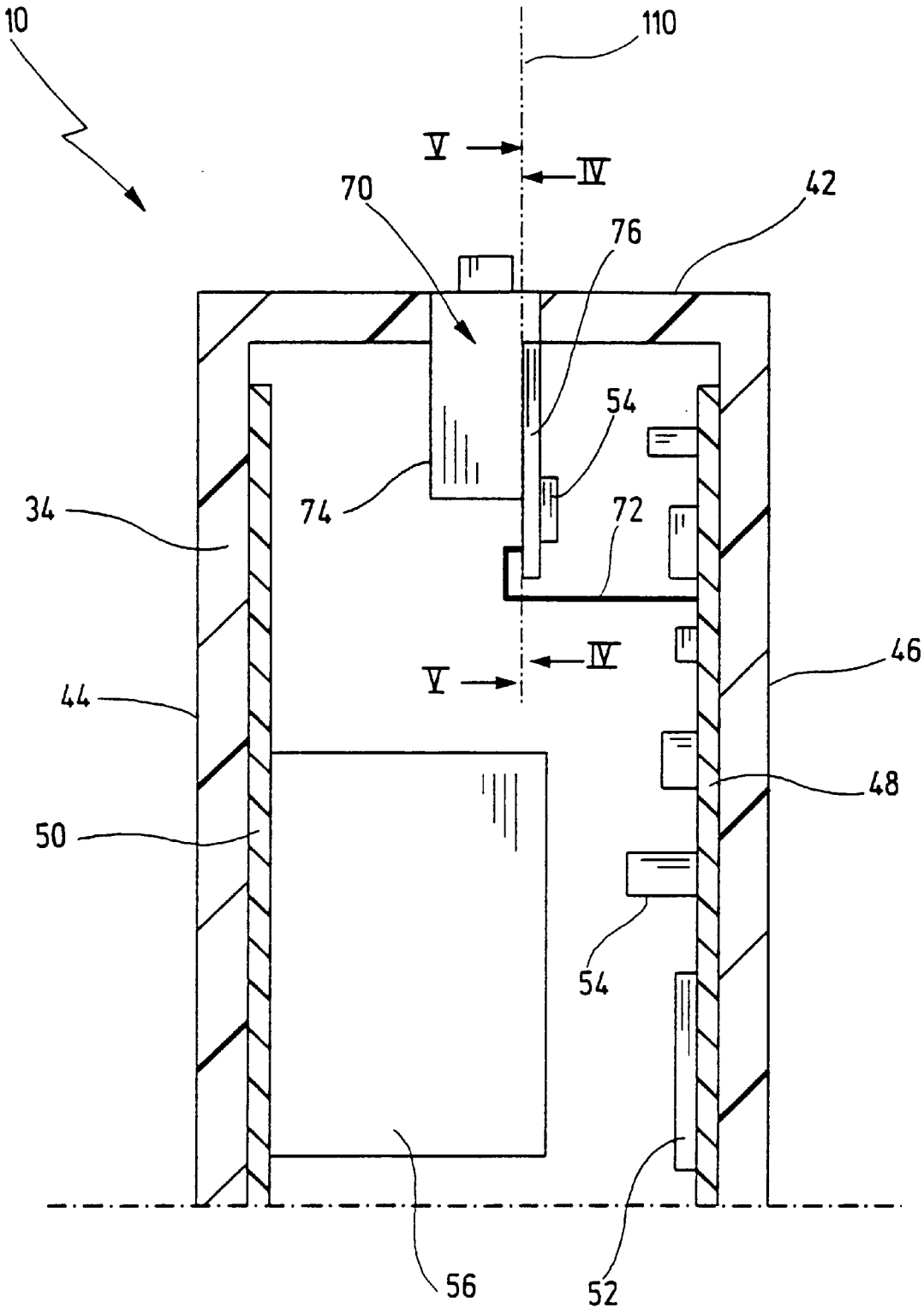
FIG. 3 shows a cross section of the safety switching device according to the invention as shown in FIG. 1.

As can be seen in FIG. 3, the safety switching device 10 according to the invention differs from the known safety switching device 40 in that, inter alia, there is no need for the two circuit boards 58, 60 which are arranged parallel to the front face 42. Instead of this, the two input switches 12 and 14 in this exemplary embodiment are located in a common input switch unit 70, whose configuration will be explained in more detail in the following text with reference to FIGS. 4 and 5. The input switch unit 70 is connected to the circuit board 48 via contact pins 72. However, this arrangement reflects only one possible exemplary embodiment.

In alternative exemplary embodiments, the input switch unit 70 may also be made contact with via a circuit board 58 which is arranged parallel to the front face 42. In contrast to the known safety switching device 40, it is, however, not essential to have a circuit board 58 such as this or a second circuit board 60, arranged parallel to it.

Figure 4:
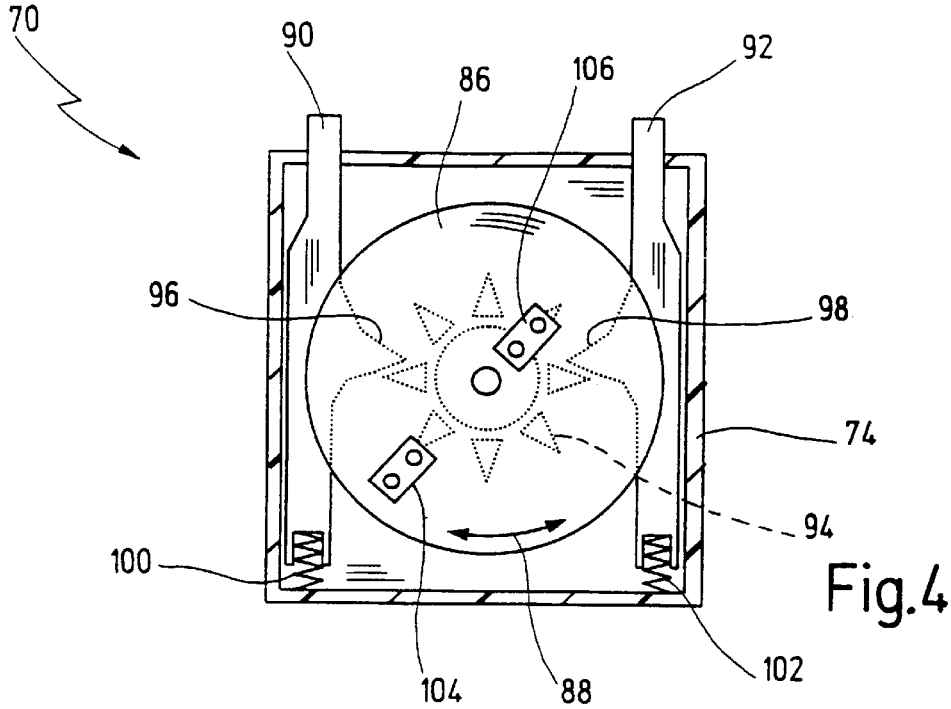
FIG. 4 shows an input switch unit for the safety switching device as shown in FIG. 3, along the line IV—IV.
Figure 5:
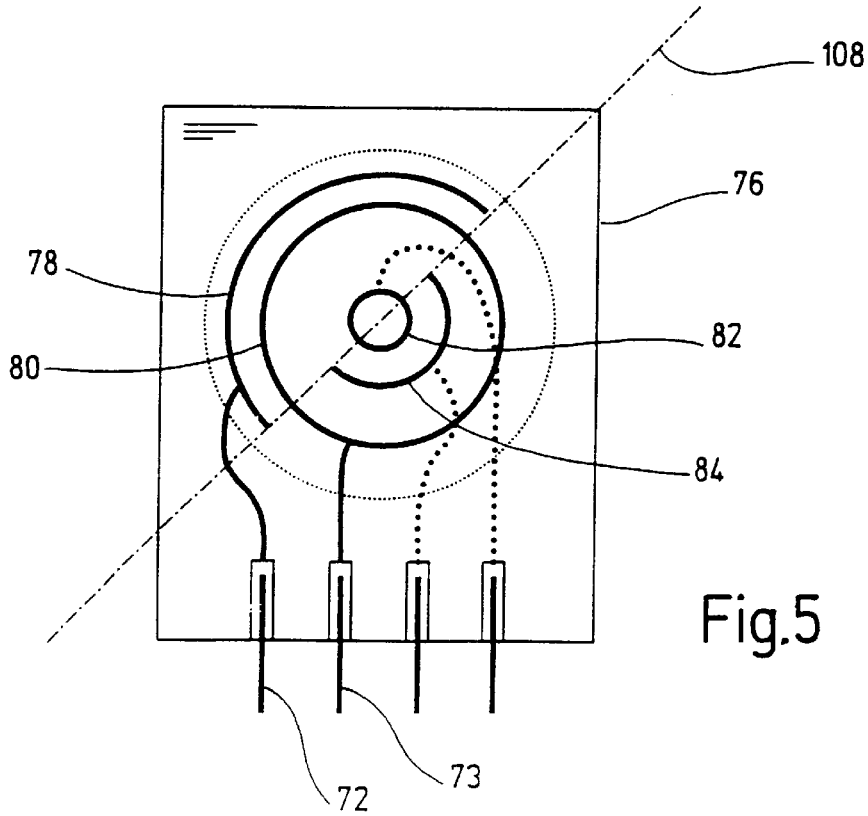
FIG. 5 shows the input switch unit for the safety switching device shown in FIG. 3, along the line V—V.

According to FIGS. 4 and 5, the input switch unit 70 has a switch enclosure 74, in which the mechanical operating parts are accommodated. The switch enclosure 74 is arranged on a printed circuit board 76. On its side facing the switch enclosure 74, the circuit board 76 has a number of conductive tracks 78, 80, 82, 84, which run along circular paths. Each of the conductive tracks 78 to 84 is connected to a respective contact pin 72, with the connections for the conductive tracks 82 and 84 being located on the rear face of the board 76 in the present exemplary embodiment, as is represented by the dotted line.

A circular mounting disk 86, which can be rotated in the direction of the arrow 88, is arranged in the switch enclosure 74 of the input switch unit 70. The mounting disk 86 is operated selectively by means of one of two buttons 90, 92, which are each arranged tangentially and parallel to one another along two side walls of the switch enclosure 74. On the side facing away from the circuit board 76, the mounting disk 86 has a star-shaped structure 94, in which studs 96, 98 on the two buttons 90, 92 can engage. At their end at the bottom in FIG. 4, the buttons 90, 92 are supported by springs 100, 102 against the rear wall of the switch enclosure 74. The operation of one of the two buttons 90, 92 thus results in the mounting disk 86 being rotated in the direction of the arrow 88 by in each case one tooth pitch of the star-shaped structure 94.

The mechanical configuration of such switches is known per se. By way of example, one mechanically comparable switch is distributed under the designation "two-button coding switch" by the company Fritz Hartmann Geräte bau GmbH & Co. KG at 91083 Baiersdorf, Germany.

In contrast to these known two-button coding switches, there are, however, two mutually separate sliding contact pairs 104 and 106, which are arranged radially offset with respect to one another, on that side of the mounting disk 86 which faces the circuit board 76, in the present exemplary embodiment. The pair of sliding contacts 104 in this case interact with the conductive tracks 78 and 80, while the pair of sliding contacts 106 interact with the conductive tracks 82 and 84. When the pair of sliding contacts 104 is located in an angle range above the diagonal 108 shown in FIG. 5, this produces a conductive connection between the otherwise conductively isolated conductive tracks 78 and 80. In this case, the input switch 12 between the contact pins 72 and 73 is closed.

When, in contrast, the pair of sliding contacts 104 are located in an angle position which is underneath the diagonal 108 shown in FIG. 5, there is no conductive connection between the conductor tracks 78 and 80, so that the switch between the contact pins 72 and 73 is open.

The same applies in an identical manner to the pair of sliding contacts 106, which interact with the conductive tracks 82 and 84. The conductive tracks 78 to 84 are in this case arranged with respect to one another on the circuit board 76 such that the input switches 12 and 14 produced in this way in each case switch at the same time and redundantly with respect to one another.

As can easily be seen, the switching logic for the input switch unit 70 is provided primarily by the arrangement of the conductive tracks 78 to 84 on the circuit board 76. The present exemplary embodiment has in this case been chosen deliberately to be simple, in order to explain the invention. However, it is self-evident that redundant multiposition switches can also be produced by suitable choice of the conductive track structure.

The input switch unit 70 is one particularly preferred exemplary embodiment of a safety switching device 10 according to the invention. As can be seen from FIG. 3, the pairs of sliding contacts 104, 106 as well as the conductive track structures 78 to 84, that is to say all the switching contacts of the two input switches 12 and 14, are in this case located within a common plane 110. However, it is not absolutely essential to use a two-button switch of the illustrated type in order to implement the invention in this case. In alternative exemplary embodiments of the invention, the mounting disk 86 may for example also be adjusted via a shaft 62 and a rotary knob 64, as is known from the safety switching device 40.

When using multiposition switches for the input switches 12 and 14, the number of contact pins required increases in principle twice as quickly as the number of desired switch positions. Furthermore, the factor of two also applies to the redundant design of the safety switching device 10. Thus, if 16 switch positions were required, it would intrinsically be necessary to have 64 contact pins, and corresponding connection options. This number can be reduced by suitable coding of the switch positions, by means of a matrix structure.

Figure 6:
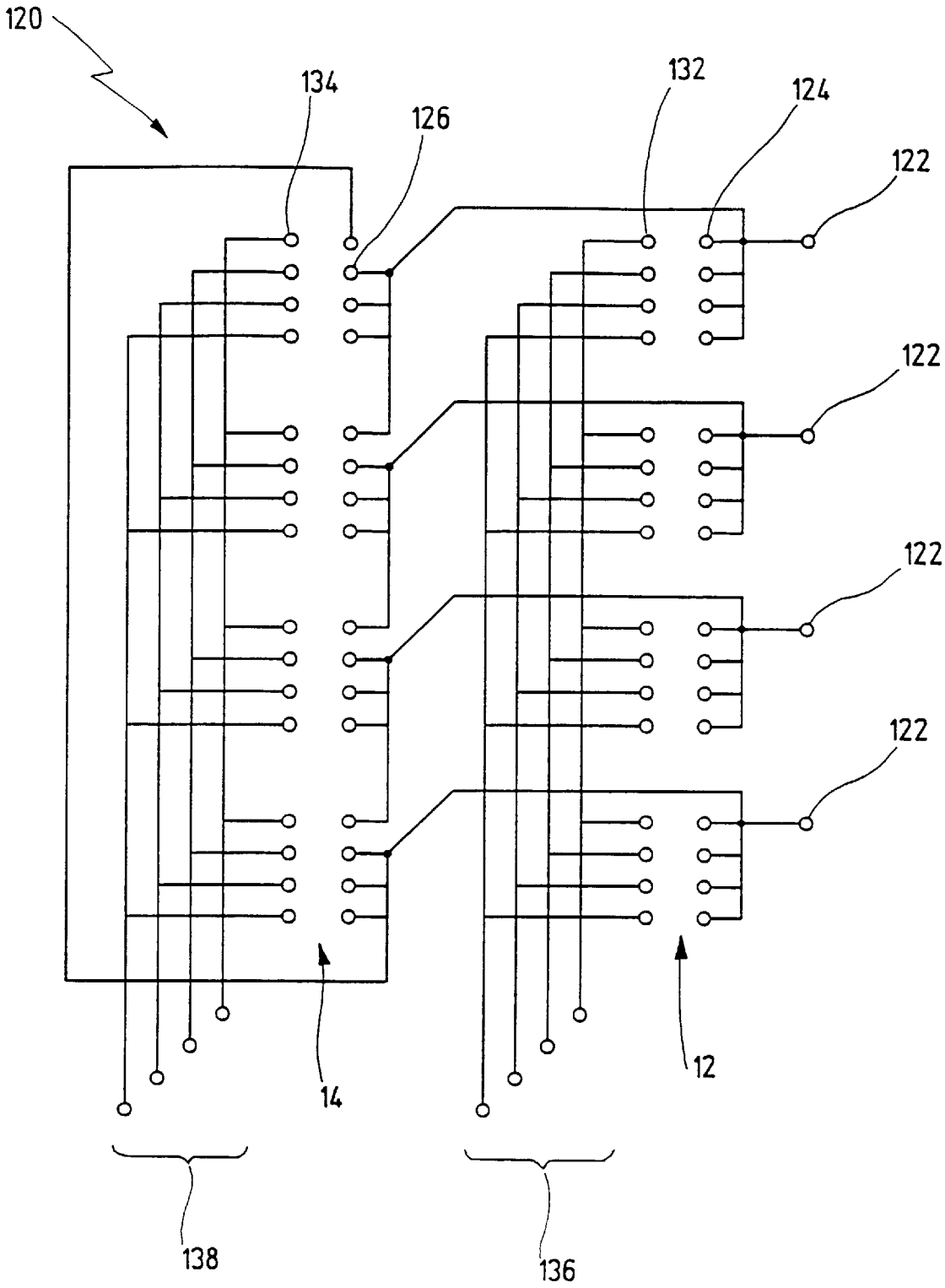
FIG. 6 shows a preferred matrix structure, in which the input-side and output-side switching contacts of two mutually redundant input switches are arranged.

FIG. 6 shows a preferred exemplary embodiment of a matrix structure 120 for the input switches 12 and 14. The matrix structure 120 in this case has four connecting contacts 122, which are supplied in parallel to switching contacts 124, 126 of the two input switches 12 and 14. In the present exemplary embodiment, the mutually associated switching contacts 124, 126 are in each case shifted by one step with respect to one another, that is to say the uppermost switching contact 124 of the input switch 12 in FIG. 6 is in this case connected to the second switching contact 126 from the top of the input switch 14 in FIG. 6. As an alternative to this, the switching contacts 124, 126 of the two input switches 12 and 14 may, however, also be connected to one another shifted by different step widths. In this case, a step width of zero, that is to say a mirror-image association between the switching contacts 124, 126 with respect to one another, is also possible.

The output-side switching contacts 132, 134 of the two input switches 12 and 14 are connected to output-side connecting contacts 136, 138 separately from one another. By virtue of the matrix arrangement, it is in this case possible to determine the respective current switch positions of the input switches 12 and 14 by comparison and evaluation of the signals at the input-side connecting contacts 122 and at the output-side connecting contacts 136, 138. In this case, by virtue of the common input-side connecting contacts 122 and the separate output-side connecting contacts 132, 134, the illustrated matrix structure 120 allows fail-safe evaluation with a minimal number of connecting contacts.

What is claimed is:

1. A safety switching apparatus for safely switching off a machine system which is causing a hazard, said switching apparatus having a first and a second input switch each comprising switching contacts, an evaluation and control unit, and an output circuit comprising at least one output switching element, said evaluation and control unit comprising two channels, with a first channel being connected to the first input switch, and a second channel being connected to the second input switch, said first and second input switches each providing a switch setting, and said switch settings defining an input-sided manipulated variable redundantly with respect to one another for said evaluation and control unit, said evaluation and control unit driving the at least one output switching element as a function of said defined manipulated variable, wherein the switching contacts of said first and second input switches are spatially arranged in one plane and coupled to one another, in terms of their switch positions, via a common actuating member, and wherein said common actuating member comprises a common mounting element, on which said switching contacts of said first and second input switch are arranged radially offset with respect to one another, such that said first and second input switches each switch at the same time, and redundantly with respect to one another.

2. The safety switching apparatus of claim 1, wherein said common mounting element is a mounting disk that can be rotated for adjustment.

3. The safety switching apparatus of claim 1, further comprising a common switch enclosure which accommodates said first and second input switches as well as said common actuating member, thereby providing an intrinsically redundant input switching unit.

4. The safety switching apparatus of claim 1, wherein said first and second switches each comprise sliding contacts as switching contacts and stationary contact surfaces, said sliding contacts being movable over said stationary contact surfaces by means of said actuating member for adjusting said switch settings.

5. The safety switching apparatus of claim 1, wherein said first and second input switches each have input-sided and output-sided terminal contacts, said input-sided and output-sided terminal contacts being arranged in a matrix structure with respect to one another.

6. The safety switching apparatus of claim 5, wherein said input-sided terminal contacts of said first and second input switches are connected to one another.

7. A safety switching apparatus for safely stopping a machine system which is causing a hazard, said switching apparatus having a first and a second input switch, each comprising switching contacts and each allowing a switch setting, said switch settings defining an input-sided manipulated variable redundantly with respect to one another, an output circuit comprising at least one output switching element, and an evaluation and control unit which controls the at least one output switching element as a function of said redundantly defined manipulated variable, wherein said first and second switches are coupled to one another, in terms of said switch settings, via a common actuating member, and wherein said switching contacts are spatially arranged in one plane.

8. The safety switching apparatus of claim 7, wherein said actuating member comprises a common mounting element, on which said switching contacts are arranged spatially offset with respect to one another.

9. The safety switching apparatus of claim 7, wherein said common mounting element can be rotated for adjustment.

10. The safety switching apparatus of claim 7, wherein said common mounting element is a mounting disk, on which said switching contacts are arranged radially offset with respect to one another.

11. The safety switching apparatus of claim 7, further comprising a common switch enclosure which accommodates said first and second input switches as well as said common actuating member, thereby providing an intrinsically redundant input switching unit.

12. The safety switching apparatus of claim 7, wherein said first and second switches each comprise sliding contacts as switching contacts and stationary contact surfaces, said sliding contacts being movable over said stationary contact surfaces by means of said actuating member for adjusting said switch settings.

13. The safety switching apparatus of claim 12, wherein said contact surfaces are conductive track structures arranged on a printed circuit board.

14. The safety switching apparatus of claim 7, wherein said first and second input switches each are multiposition switches.

15. The safety switching apparatus of claim 7, wherein said first and second input switches each have input-sided and output-sided terminal contacts, which are connectable in a matrix structure via said switching contacts.

16. The safety switching apparatus of claim 15, wherein said input-sided terminal contacts of said first and second input switch are connected to one another.

17. The safety switching apparatus of claim 7, wherein said evaluation and control unit has two channels, with a first channel being connected to said first input switch, and a second channel being connected to said second input switch.

18. A method of manufacturing a safety switching apparatus for safely switching off a machine system which is causing a hazard, said method comprising the steps of providing an intrinsically redundant input switching unit, said input switching unit comprising a first and a second input switch, said first and second input switches comprising switching contacts which are spatially arranged in one plane and coupled to one another, in terms of their switch positions, via a common actuating member, such that said first and second input switches each switch at the same time and redundantly with respect to one another, said switching unit further comprising a common switch enclosure accommodating said first and second input switches and said common actuating member, providing an evaluation and control unit and an output circuit comprising at least one output switching element, said evaluation and control unit having two channels, implementing said input switching unit, said evaluation and control unit, and said output circuit in a device enclosure, connecting said first input switch with said first channel and said second input switch with said second channel, and connecting said at least one output switching element with said evaluation and control unit.

* * * * *

UNITED STATES PATENT AND TRADEMARK OFFICE

CERTIFICATE OF CORRECTION

PATENT NO. : 6,825,579 B2
DATED : Noember 30, 2004
INVENTOR(S) : Gerhard Ehrlich et al.

It is certified that error appears in the above-identified patent and that said Letters Patent is hereby corrected as shown below:

Column 9,
Line 7, “claim 7” should be -- claim 8 --.

Signed and Sealed this

Eighth Day of March, 2005

JON W. DUDAS
*Director of the United States Patent and Trademark Office*